US009834409B2

(12) United States Patent
Kere et al.

(10) Patent No.: US 9,834,409 B2
(45) Date of Patent: Dec. 5, 2017

(54) ROPE OF A LIFTING DEVICE FOR AN ELEVATOR AND A CONDITION MONITORING METHOD FOR THE ROPE

(71) Applicant: KONE CORPORATION, Helsinki (FI)

(72) Inventors: Petri Kere, Helsinki (FI); Riku Lampinen, Helsinki (FI); Raimo Pelto-Huikko, Vantaa (FI); Petteri Valjus, Helsinki (FI); Lasse Heikkilä, Helsinki (FI)

(73) Assignee: KONE CORPORATION, Helsinki (FI)

( * ) Notice: Subject to any disclaimer, the term of this patent is extended or adjusted under 35 U.S.C. 154(b) by 0 days.

(21) Appl. No.: 14/314,939

(22) Filed: Jun. 25, 2014

(65) Prior Publication Data

US 2014/0305744 A1 Oct. 16, 2014

Related U.S. Application Data

(63) Continuation of application No. PCT/FI2013/050048, filed on Jan. 16, 2013.

(30) Foreign Application Priority Data

Jan. 24, 2012 (FI) ..... 20125073

(51) Int. Cl.
*B66B 7/06* (2006.01)
*B66B 11/08* (2006.01)
(Continued)

(52) U.S. Cl.
CPC ..... *B66B 5/0018* (2013.01); *B66B 7/06* (2013.01); *B66B 7/062* (2013.01); *B66B 7/1238* (2013.01);
(Continued)

(58) Field of Classification Search
CPC ..... B66B 7/062; B66B 7/1238; B66B 11/008; B66B 11/009; D07B 1/145
See application file for complete search history.

(56) References Cited

U.S. PATENT DOCUMENTS 2,526,324 A * 10/1950 Bloomfield ..... F16G 1/16 156/175
4,151,755 A * 5/1979 Allaben, Jr. ..... F16G 1/08 474/250
(Continued)

FOREIGN PATENT DOCUMENTS

CN 101977834 A 2/2011
CN 102264623 A 11/2011
(Continued)

OTHER PUBLICATIONS

WIPO, Machine Translation, WO 2010072690 A1,Feb. 8, 2014, pp. 3-13.*
(Continued)

*Primary Examiner* — William A Rivera
*Assistant Examiner* — Stefan Kruer
(74) *Attorney, Agent, or Firm* — Birch, Stewart, Kolasch & Birch, LLP

(57) ABSTRACT

In a rope of a lifting device, particularly of a passenger transport elevator and/or freight transport elevator, the width of which rope is greater than the thickness in the transverse direction of the rope, which rope includes a load-bearing part in the longitudinal direction of the rope, which load-bearing part includes carbon-fiber reinforced, aramid-fiber reinforced and/or glass-fiber reinforced composite material in a polymer matrix, and which rope includes one or more optical fibers and/or fiber bundles in connection with the load-bearing part and the optical fiber and/or fiber bundle is laminated inside the load-bearing part and/or the optical fiber and/or fiber bundle is glued onto the surface of the
(Continued)

load-bearing part and/or and that the optical fiber and/or fiber bundle is embedded or glued into the polymer envelope surrounding the load-bearing part, as well as to a condition monitoring method for the rope of a lifting device.

27 Claims, 3 Drawing Sheets

(51) Int. Cl.
*B66B 7/12* (2006.01)
*B66B 5/00* (2006.01)
*D07B 1/14* (2006.01)
*D07B 1/22* (2006.01)

(52) U.S. Cl.
CPC ..... *D07B 1/145* (2013.01); *D07B 1/22* (2013.01); *D07B 2201/2096* (2013.01); *D07B 2205/205* (2013.01); *D07B 2205/3003* (2013.01); *D07B 2205/3007* (2013.01); *D07B 2501/2007* (2013.01)

(56) References Cited

U.S. PATENT DOCUMENTS 4,523,804 A * 6/1985 Thompson ..... G02B 6/4427 385/107
4,696,542 A * 9/1987 Thompson ..... 385/108
5,182,779 A * 1/1993 D'Agostino et al. ..... 385/13
6,453,960 B1 * 9/2002 Kondo ..... C08J 5/24 152/451
7,154,081 B1 * 12/2006 Friedersdorf ..... G01B 11/18 250/227.14
2003/0121729 A1 * 7/2003 Heinz et al. ..... 187/254
2004/0262087 A1 * 12/2004 Ach ..... 187/264
2005/0226584 A1 * 10/2005 Williams et al. ..... 385/130
2005/0245338 A1 11/2005 Eichhorn et al.
2007/0062762 A1 * 3/2007 Ach ..... B66B 7/062 187/266
2008/0148704 A1 6/2008 Angelis
2008/0149430 A1 * 6/2008 De Angelis ..... 187/251
2009/0080472 A1 * 3/2009 Yao ..... H01S 3/06716 372/6
2011/0000746 A1 * 1/2011 Pelto-Huikko et al. ..... 187/254
2011/0192683 A1 * 8/2011 Weinberger et al. ..... 187/254
2011/0240408 A1 * 10/2011 Wesson et al. ..... 187/251
2011/0253487 A1 10/2011 Kocher et al.
2011/0266097 A1 * 11/2011 Valjus et al. ..... 187/254

FOREIGN PATENT DOCUMENTS

CN 102869596 A 1/2013
EP 1 199 276 A1 4/2002
EP 1357073 A1 * 10/2003 ..... B66B 5/02
FI WO 2010081935 A1 * 7/2010 ..... B66B 5/16
FI WO 2013110853 A1 * 8/2013 ..... B66B 7/1238
GB WO 0198743 A1 * 12/2001 ..... G01L 5/105
JP 4-315702 A 11/1992
JP 2001-302135 A 10/2001
JP EP 1561719 A1 * 8/2005 ..... B66B 7/062
WO WO 02/34659 A1 5/2002
WO WO 2009/026730 A1 3/2009
WO WO 2009/090299 A1 7/2009
WO WO 2010/072690 A1 7/2010
WO WO 2011/128223 A2 10/2011
WO WO 2011/148033 A1 12/2011

OTHER PUBLICATIONS

WIPO, Machine Translation, WO 2010072690 A1, Elevator Support Means, Mfg. Method for Said Support Means and Elevator System Comprising said Support Means, Mar. 14, 2016, pp. 1-20.*
Eric Pinet, "Fabry-Perot Fiber-Optics Sensors for Physical Parameters Measurement in Challenging Conditions," Journal of Sensors, vol. 2009, 9 pages, Jan. 1, 2009.
Jose Luis Santos, "Handbook of Optical Sensors," pp. 336-337, Oct. 1, 2014.

* cited by examiner

ROPE OF A LIFTING DEVICE FOR AN ELEVATOR AND A CONDITION MONITORING METHOD FOR THE ROPE

CROSS REFERENCE TO RELATED APPLICATIONS

This application is a Bypass Continuation of PCT International Application No. PCT/FI2013/050048 filed on Jan. 16, 2013, which claims priority under 35 U.S.C. §119(a) to Patent Application No. 20125073 filed in Finland on Jan. 24, 2012, all of which are hereby expressly incorporated by reference into the present application.

FIELD OF THE INVENTION

The object of the invention is a rope of a lifting device, a rope arrangement, an elevator, and a condition monitoring method for the rope of a lifting device.

BACKGROUND OF THE INVENTION

The elevator car of elevators is most generally moved with hoisting roping, which comprises one or more ropes. To ensure safety and availability, the hoisting roping must be kept in good condition. The hoisting roping is most generally fixed at its ends to the building and/or to the elevator car and to the counterweight, depending on the suspension ratio and otherwise on the type of roping. In connection with the operation of the elevator, the hoisting roping with its rope(s) moves as the elevator car moves. The speed of movement of the elevator car and of the hoisting ropes is most generally controlled with a traction sheave, and the hoisting ropes are also guided to pass along the desired route by means of diverting pulleys. Wear is caused in the hoisting ropes over time owing to, among other things, fatigue produced by their guidance and by traction sheave contact as well as by repeated bending and tensile stress.

The ropes of the suspension roping of elevators, including the overspeed governor ropes of the elevator, have conventionally been manufactured from metal. Known in the art are also elevators in which is used hoisting roping comprising ropes that have load-bearing composite parts. This type of solution is presented in e.g. publication WO 2009090299. The overspeed governor ropes of an elevator are helical ropes of round cross-sectional shape, the force-transmitting parts of which ropes are of metal material. A problem in solutions according to prior-art is that the strength properties of metal in relation to its mass are such that the mass of the rope increases to be large. When producing acceleration or deceleration in the elevator car, a corresponding change in speed must also be produced in the overspeed governor rope. The magnitude of the energy consumed for this depends on the mass of the rope. Yet another problem has been the creeping of metal ropes.

It is known in the art that the condition of prior-art ropes of an elevator can be assessed visually. One problem, among others, is that it has been necessary to assess the condition of all the ropes of an elevator separately. Problems have also been caused by the fact that it has been awkward to visually observe the condition of coated ropes of an elevator.

Efforts have been made to solve the problem of condition monitoring in connection with composite-structured elevator ropes according to prior art with a method wherein one of the load-bearing parts of the rope is arranged to be more susceptible to breakage in relation to the number of bends than the other load-bearing parts, and in the method the condition of the load-bearing part that is most susceptible to breakage is monitored.

There have, however, been problems with the reliability of the method and it has not been possible with the method to obtain quantitive data about the wear of an elevator rope.

BRIEF SUMMARY OF THE INVENTION

The aim of the invention is to eliminate, inter alia, the aforementioned drawbacks of prior-art solutions. The aim of the invention is to improve the condition monitoring of composite-structured ropes of a lifting device, more particularly of a passenger transport elevator and/or freight transport elevator.

The aim of the invention is to achieve one or more of the following advantages, among others:

- A safe rope of an elevator and an elevator with safe roping are achieved.
- An efficient and reliable condition monitoring method is achieved, with which also quantitive data about the condition of a rope can be achieved.
- An elevator rope, a condition monitoring method for an elevator rope and an elevator that are advantageous from the viewpoint of condition monitoring are achieved.
- A rope of an elevator is achieved that is lightweight and of high tensile strength and tensile stiffness with respect to its self-weight.
- A rope of an elevator is achieved that possesses high thermal conductivity combined with a high operating temperature.
- A rope of an elevator is achieved that has a simple, belt-like structure and that is simple to manufacture.
- A rope is achieved that comprises one straight or a number of essentially parallel straight load-bearing parts, in which case the behavior in bending is advantageous.
- An elevator with lightweight roping is achieved.
- An elevator and the rope of an elevator are achieved, in which the moving and accelerating masses as well as the shaft loads are smaller than before.
- An elevator and a rope are achieved, in which there is no discontinuity or intermittency of the rope, owing to which the rope of the elevator is quiet and advantageous in terms of vibration.
- A rope is achieved that has little internal wear.
- A rope is achieved that has good fatigue endurance.
- An energy-efficient elevator is achieved.
- A space-efficient elevator is achieved, the overspeed governor rope of which is lightweight and has a small bending radius.
- An elevator is achieved, the mass of the parts of which that move along with the car is lower than before.
- An elevator is achieved, the creeping of the overspeed governor rope of which is minor.
- An elevator is achieved, the braking of the overspeed governor rope of which can be implemented with a large surface area simply and gently without damaging the fibers of the rope.
- An elevator is achieved, the lateral movement of the overspeed governor rope of which is minor.

The invention is based on the concept that in elevator systems the elevator car, the counterweight, or both, can be supported and/or moved safely with a composite-structured rope according to the invention, and according to the invention condition monitoring of the aforementioned rope can be arranged using long sensors that are even hundreds of meters in length. The rope according to the invention is also suited for use as an overspeed governor rope and as a compensating rope. The rope according to the invention is applicable for use in both elevators provided with a counterweight and without a counterweight. The rope and/or rope arrangement according to the invention can also be used in connection with other lifting devices, e.g. in the roping of cranes. The lightweightness of composite-structured rope is useful, especially in accelerating situations, because the energy required by changes in the speed of the rope depends on its mass. In addition, lightweightness makes handling of the ropes easier.

Some inventive embodiments are also presented in the descriptive section and in the drawings of the present application. The inventive content of the application can also be defined differently than in the claims presented below. The inventive content may also consist of several separate inventions, especially if the invention is considered in the light of expressions or implicit sub-tasks or from the point of view of advantages or categories of advantages achieved. In this case, some of the attributes contained in the claims below may be superfluous from the point of view of separate inventive concepts. The features of the various embodiments of the invention can be applied within the scope of the basic inventive concept in conjunction with other embodiments.

Preferably the cross-section of the rope is of rectangular shape or a conic section and the width of the rope is greater than the thickness.

Preferably the rope comprises a plurality of load-bearing parts in the longitudinal direction of the rope, which parts are distributed in the rope at a distance from each other in the width direction of the rope, and which rope can be bent around the neutral axis of the width direction of the rope, and that the rope comprises at least one load-bearing part that extends in the thickness direction of the rope to a first distance from the neutral axis of the width direction of the rope and at least one load-bearing part that extends to a second distance from the neutral axis of the width direction of the rope, which second distance is greater than the first distance.

Preferably the load-bearing parts of the rope are of essentially the same material, preferably of completely the same material.

Preferably the aforementioned load-bearing parts are fiber-reinforced composite material, preferably glass-fiber reinforced, more preferably aramid-fiber reinforced, most preferably carbon-fiber reinforced composite material.

Preferably the aforementioned load-bearing parts are a polymer fiber reinforced material, e.g. a polybenzoxazole fiber reinforced, or a polyethylene fiber reinforced, such as an UHMWPE fiber reinforced, or a nylon fiber reinforced composite material. Thus all the reinforcements are more lightweight than metal fibers.

Preferably the proportion by volume of the reinforcements of each aforementioned load-bearing part is at least 50 percent by volume reinforcing fibers in the load-bearing part. In this way the longitudinal mechanical properties of the load-bearing part are adequate.

Preferably the proportion of the reinforcements of each aforementioned load-bearing part is at least 50 percent by weight reinforcing fibers in the load-bearing part. In this way the longitudinal mechanical properties of the load-bearing part are adequate.

Preferably at least 50 percent of the surface area of the cross-section of each aforementioned load-bearing part is reinforcing fibers. In this way the longitudinal mechanical properties of the load-bearing part are adequate.

Preferably the aforementioned load-bearing part or aforementioned load-bearing parts together cover over 40 percent of the surface area of the cross-section of the rope, preferably 50 percent or over, even more preferably 60 percent or over, even more preferably 65 percent or over. In this way a large part of the cross-sectional area of the rope is load-bearing.

Preferably the aforementioned load-bearing parts are fiber-reinforced hybrid composite material, preferably glass-fiber reinforced and/or aramid-fiber reinforced and/or carbon-fiber reinforced hybrid composite material. In this way the optimal mechanical properties, such as strength properties, stiffness properties, vibration properties and/or thermo-mechanical properties can always be selected for the rope according to need.

In one embodiment one of the load-bearing composite parts of the rope, preferably two, most preferably each composite part, comprises inside it one or more optical fibers, most preferably of all a fiber bundle or fiber coil, which is disposed essentially inside and/or in the proximity of the surface of the load-bearing part in question as viewed in the thickness direction of the rope. Thus good measurement accuracy is achieved.

In one embodiment the condition monitoring method for a rope is based on measuring, wherein an optical fiber functions as an optical Fabry-Pérot-type sensor.

In one embodiment the condition monitoring method for a rope is based on measuring, wherein a single-piece optical fiber is used as an optical fiber, which comprises Bragg gratings, i.e. the Fiber Bragg Grating FBG method is applied in the condition monitoring of the rope.

In one embodiment the condition monitoring method for a rope is based on measuring, wherein a sensor functioning on the Time-Of-Flight TOF principle is used as an optical fiber, In one embodiment the condition monitoring method for a rope is based on measuring, wherein a sensor based on Brillouin spectrum measurement is used as an optical fiber.

Preferably the tensile strengths and/or the moduli of elasticity of at least some, most preferably all, the load-bearing parts are dimensioned to be essentially the same.

Preferably the surface areas of the cross-sections of at least some, most preferably all, the load-bearing parts are essentially the same.

Preferably the load-bearing part is visible outside the rope, owing to the transparency of the matrix material binding the load-bearing parts to each other.

Preferably the rope and/or rope arrangement of a lifting device, more particularly of a passenger transport elevator and/or freight transport elevator, which rope and/or rope arrangement comprises a plurality of ropes, which are arranged to move the elevator car e.g. by means of a traction sheave. Preferably at least one of the aforementioned ropes is provided with one or more optical fiber, most preferably with a fiber bundle or fiber coil.

Preferably the width/thickness ratio of the rope is at least 2 or more, preferably at least 4, or even 5 or more, or even 6 or more, or even 7 or more or even 8 or more. In this way good force-transmitting capability is achieved with a small bending radius. This can be implemented preferably with the fiber-reinforced composite material presented in this patent application, which material has a very advantageously large width/thickness ratio owing to the rigidity of the structure.

Preferably the width of each aforementioned force-transmitting part is greater than the thickness, preferably such that the width/thickness ratio of each aforementioned force-transmitting part is at least 1.3 or more, or even 2 or more, or even 3 or more, or even 4 or more, or even 5 or more. In this way a wide rope can be formed simply and to be thin.

Preferably the plurality mentioned in the rope arrangement comprises a plurality of ropes, of which each rope can be bent around the neutral axis of the width direction of the rope. Each aforementioned rope comprises at least one or more optical fibers, preferably a fiber bundle or fiber coil, in the proximity of surface of the load-bearing part, inside the load-bearing part and/or embedded into the polymer matrix.

Preferably the optical fibers and/or fiber bundles comprised in the aforementioned rope or rope arrangement are essentially translucent to LED light or laser light. Thus the condition of the load-bearing part can be monitored by monitoring changes in one of its optical properties.

Preferably the density of the aforementioned reinforcing fibers of the aforementioned rope or rope arrangement is less than 3.5 kg/m3, and the tensile strength is over 2 GPa. One advantage is that the fibers are lightweight, and not many of them are needed because they are strong.

Preferably the load-bearing part of the aforementioned rope or rope arrangement is an unbroken elongated rod-like piece.

Preferably the load-bearing part of the aforementioned rope or rope arrangement is essentially parallel with the longitudinal direction of the rope.

Preferably the structure of the aforementioned rope or of the rope of the rope arrangement continues essentially the same for the whole distance of the rope.

Preferably the aforementioned reinforcing fibers and one or more optical fibers are in the longitudinal direction of the rope.

Preferably individual reinforcing fibers and/or one or more optical fibers and/or fiber bundles are homogeneously distributed in the aforementioned matrix.

Preferably the aforementioned reinforcing fibers and/or one or more optical fibers and/or fiber bundles are continuous fibers in the longitudinal direction of the rope, which fibers preferably continue for the whole length of the rope.

Preferably the aforementioned reinforcing fibers and/or the one or more optical fibers and/or fiber bundles are bound into an unbroken load-bearing part with the aforementioned polymer matrix, preferably in the manufacturing phase by disposing the optical fibers between or on the surface of the prepeg layers or by laminating the reinforcing fibers and the optical fibers in the material of the polymer matrix.

Preferably the aforementioned load-bearing part is composed of straight reinforcing fibers essentially parallel with the longitudinal direction of the rope and/or of one or more optical fibers and/or fiber bundles, which are bound into an unbroken part with the polymer matrix.

Preferably essentially all the reinforcing fibers of the aforementioned load-bearing part and/or one or more optical fibers and/or fiber bundles are in the longitudinal direction of the rope.

Preferably the structure of the load-bearing part continues essentially the same for the whole distance of the rope.

Preferably the polymer matrix is a non-elastomer.

Preferably the module of elasticity E of the polymer matrix material is over 1.5 GPa, most preferably over 2 GPa, even more preferably in the range 2-10 GPa, most preferably of all in the range 2.5-4 GPa.

Preferably the polymer matrix comprises epoxy, polyester, phenolic plastic or vinyl ester.

Preferably over 45 percent of the surface area of the cross-section of the load-bearing part is the aforementioned reinforcing fiber, preferably such that 45-85 percent is the aforementioned reinforcing fiber, more preferably such that 60-75 percent is the aforementioned reinforcing fiber and optical fiber, most preferably such that approx. 59 percent of the surface area is reinforcing fiber and at most 1 percent is optical fibers and approx. 40 percent is matrix material.

Preferably the reinforcing fibers and one or more optical fibers and/or fiber bundles together with the matrix form an unbroken load-bearing part, inside which relative abrasive movement among the fibers or between the fibers and the matrix essentially does not occur.

Preferably the width of the load-bearing part is greater than the thickness in the transverse direction of the rope.

Preferably the rope comprises a plurality of the aforementioned load-bearing parts side by side.

Preferably the load-bearing part is surrounded with a polymer layer, which is preferably an elastomer, most preferably a high-friction elastomer such as e.g. polyurethane.

Preferably the load-bearing part or load-bearing parts cover most of cross-section of the rope.

Preferably the load-bearing part is composed of the aforementioned polymer matrix, of reinforcing fibers bound to each other by the polymer matrix and of one or more optical fibers and/or fiber bundles, and also possibly of a sizing around the fibers, and also possibly of additives mixed into the polymer matrix.

Preferably the structure of the rope continues essentially the same for the whole distance of the rope and that the rope comprises a wide and at least essentially flat, preferably fully flat, side surface for enabling force transmission based on friction via the aforementioned wide surface.

According to the invention, the elevator, more particularly a passenger transport elevator and/or freight transport elevator, comprises an elevator car, a traction sheave, and a power source for rotating the traction sheave. It comprises one of the types of rope described earlier and/or one of the types of rope arrangement described earlier. The elevator car is arranged to be moved by means of the aforementioned rope and/or rope arrangement.

Preferably the rope and/or rope arrangement is arranged to move an elevator car and a counterweight.

Preferably the elevator comprises a rope pulley, preferably in the proximity of the top end of the path of movement of the elevator car, while supported on which the rope/ropes of the suspension roping support the elevator car and the counterweight, preferably with a 1:1 suspension or alternatively with a 2:1 suspension.

According to the invention the elevator comprises means for monitoring the condition of the optical fibers and/or fiber bundles of the rope, which means monitor from the load-bearing parts of the rope the condition of preferably only the aforementioned one or more optical fibers and/or fiber bundles.

Preferably in the method for monitoring the condition of a rope and/or roping, which rope and/or roping comprises a plurality of optical fibers and/or fiber bundles, a plurality of optical fibers and/or fiber bundles are arranged in some, preferably in one, more preferably in two, most preferably in a number of load-bearing parts, and in the method the condition of a load-bearing part containing optical fibers is monitored.

Preferably in the method the condition of all the load-bearing parts is not monitored.

It is advantageous that the condition of the load-bearing parts other than those comprising optical fibers is not monitored either at all or at least not in the same way as the condition of the parts comprising optical fibers.

Preferably in the method the condition of the rope and/or rope arrangement is monitored by monitoring the condition of the parts comprising one or more optical fibers and/or fiber bundles in one of the following ways:

- by measuring changes that have occurred in the time-of-flight of a light pulse in an optical fiber,
- by detecting changes in the spectrum and/or phase and/or wavelength of reflected, deflected or scattered light,
- by detecting visually or by the aid of a photodiode the amount of light traveling through a fiber
- by comparing the values measured from different fibers and/or fiber bundles with each other and by observing the deviations between the measured values instead of the absolute values.

In one embodiment in the method the condition of the rope and/or roping is monitored by monitoring the condition of one or more optical fibers and/or fiber bundles and if it is detected that a part comprising an optical fiber has broken or the condition of it has fallen to below a certain predefined level, a need to replace or overhaul the rope or ropes is diagnosed and rope replacement work or rope maintenance work is started.

In one embodiment in the method the condition of the rope and/or roping is monitored by monitoring the condition of a number of optical fibers and/or fiber bundles and if differences are detected between the conditions of the monitored fibers, a need to replace or overhaul the rope or ropes is diagnosed and rope replacement work or rope maintenance work is started.

Preferably with the method the condition of the rope and/or roping is monitored by monitoring changes in the properties in a part or parts of one or more optical fibers and/or fiber bundles, such as e.g. in the propagation of a light pulse and/or on the basis of changes occurring in the spectrum of the light. In one embodiment the tension produced by the weight of the elevator car/counterweight is transmitted along at least one of the aforementioned parts from the elevator car/counterweight at least to the traction sheave.

In one embodiment an optical fiber of the rope also functions as a long vibration sensor. In the vibration measuring apparatus, single-mode fiber or multimode fiber is used as a sensor and a semiconductor laser as a light source. The detection of vibration is based on measuring the changes of a speckle diagram formed of bright and dark spots occurring at the second end (in the far field) of an optical fiber.

Preferably the optical cables to be used for measuring purposes comprise a number of optical fibers needed for measurements and also, in addition to them, fibers to be used for data transfer.

BRIEF DESCRIPTION OF THE FIGURES

The invention will now be described mainly in connection with its preferred embodiments, with reference to the attached drawings, wherein.

DETAILED DESCRIPTION OF THE INVENTION

FIGS. 1*a*-1*j* present schematically preferred cross-sections of hoisting ropes according to the different embodiments of the invention, as viewed from their longitudinal direction. The rope 10, 20, 30, 40, 50, 60, 70, 80, 90, 100 presented by FIGS. 1*a*-1*j* is belt-like, i.e. the rope possesses in the first direction, which is at a right angle to the longitudinal direction of the rope, a measured thickness t, and in a second direction, which is the longitudinal direction of the rope and at a right angle to the aforementioned first direction, a measured width w, which width w is essentially greater than the thickness t. The width of the rope is thus essentially greater than the thickness. In addition the rope preferably, but not necessarily, possesses at least one, preferably two, wide and essentially flat surfaces, in which case a wide surface can be efficiently used as a force-transmitting surface utilizing friction or positive contact, because in this way an extensive contact surface is achieved. The wide surface does not need to be completely flat, but instead there can be grooves in it or protrusions on it, or it can have a curved shape. The structure of the rope continues preferably essentially the same for the whole distance of the rope. The cross-section can also, if so desired, be arranged to change intermittently, e.g. as toothing.

The rope 10, 20, 30, 40, 50, 60, 70, 80, 90, 100 comprises a load-bearing part 11, 21, 31, 41, 51, 61, 71, 81, 91, 101, which is carbon-fiber reinforced, aramid-fiber reinforced and/or glass-fiber reinforced composite, which comprises carbon fibers, aramid fibers and/or glass fibers, most preferably carbon fibers, and also one or more optical fibers, more preferably one or more fiber bundles, in a polymer matrix. The reinforcing fibers and optical fibers are longitudinal to the rope, for which reason the rope retains its structure when bending. Individual fibers are thus aligned in essentially the longitudinal direction of the rope, in which case the fibers are aligned with the force when the rope is pulled. An optical fiber and/or fiber bundle can be one continuous fiber or bundle laminated inside, or in the proximity of the surface of, the composite structure such that the fiber goes inside the structure at a first end of the rope, turns back at the other end of the rope and comes out of the structure again at the first end of the rope. A fiber and/or a fiber bundle can be coiled, i.e. the fiber can have one or more turns inside, or on the surface of, the structure such that however only one fiber and/or fiber bundle is used for the measurement, and the aforementioned fiber and/or fiber bundle can go into and come out of the same end or different ends of the rope. Also a number of parallel fibers or bundles can be used for measuring, laminated in a corresponding manner inside the composite structure or in the proximity of its surface.

Figure 1:
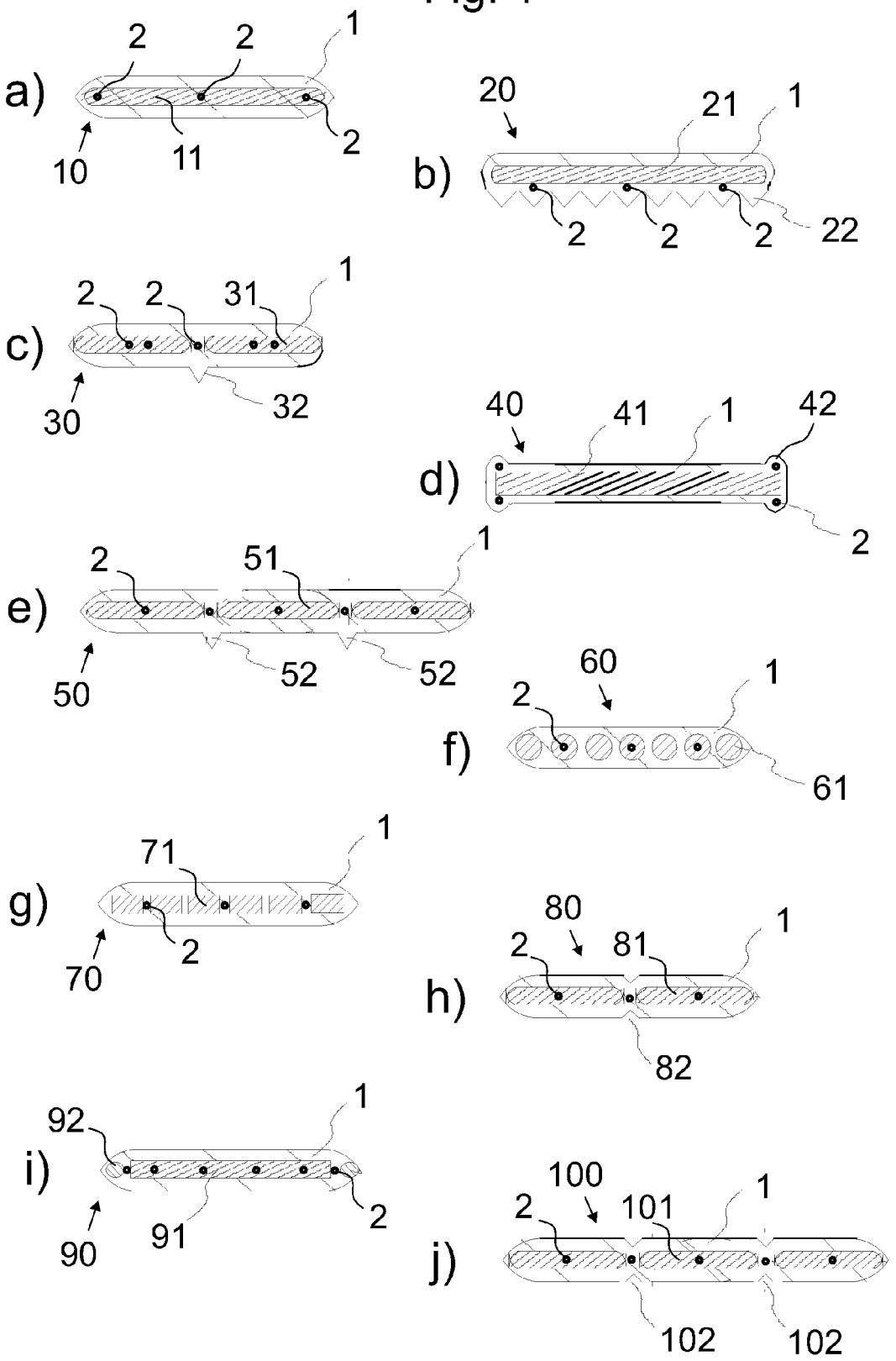
FIGS. 1*a*-1*j* present schematically one embodiment of each rope according to the invention.

The rope 10 presented in FIG. 1*a* comprises a load-bearing composite part 11 that is essentially rectangular in its cross-sectional shape, which is surrounded by a polymer envelope 1. In the cross-section of the composite part 11 of the figure, an optical fiber and/or fiber bundle 2, which can be the same fiber coiled or different parallel fibers, is seen in three points. In this way good measurement accuracy, e.g. for strain, is achieved with the system. Alternatively the rope can be formed without a polymer envelope 1.

The rope 20 presented in FIG. 1*b* comprises a load-bearing composite part 21 that is essentially rectangular in its cross-sectional shape, which is surrounded by a polymer envelope 1. A wedge surface is formed on the surface of the rope 20 with a plurality of wedge-shaped protrusions 22, which are preferably an integral part of the polymer envelope 1. In the figure, at the point of the three wedge-shaped protrusions, an optical fiber and/or fiber bundle 2 is glued essentially onto the surface of the composite part, which optical fiber and/or fiber bundle preferably comprises at least a sensor fiber, preferably also a reference fiber. The reference fiber can also be installed inside the envelope such that strain caused by the structure to be measured is not exerted on it.

The rope 30 presented in FIG. 1*c* comprises two load-bearing composite parts 31 side by side that are rectangular in their cross-sectional shape, which are surrounded by a polymer envelope 1. The polymer envelope 1 comprises at the midpoint of the wide side of the rope 30, in the center of the area between the parts 31, a protrusion 32 for guiding the rope. There can be more than two composite parts 51 side-by-side in this manner in the rope 50, as presented in FIG. 1*e*. In FIGS. 1*c* and 1*e*, an optical fiber and/or fiber bundle 2, which preferably comprises a sensor fiber and a reference fiber, is disposed both in the composite part and embedded in the polymer envelope between the composite parts. The reference fiber can also be installed inside the envelope such that strain caused by the structure to be measured is not exerted on it. The polymer envelope can also be without protrusions or a protrusion can be situated at a different point of the polymer envelope.

The rope 40 presented in FIG. 1*d* comprises a load-bearing composite part 41 that is rectangular in its cross-sectional shape, which is surrounded by a polymer envelope 1. The edges of the rope comprise bulges 42, which are preferably a part of the polymer envelope 1. An advantage of the bulges 42 is that they protect the edges of the composite part e.g. from fraying. An optical fiber and/or fiber bundle 2 is embedded in the bulge 42 in the proximity of the surface of the composite part for monitoring the condition of the composite part and/or for data transfer. A fiber and/or fiber bundle can also be glued to the surface of the polymer envelope.

The rope 60 presented in FIG. 1*f* comprises a plurality of load-bearing composite parts 61, which can also be braidings, of round cross-sectional shape, and which are surrounded by a polymer envelope 1, and in a part of which composite parts 61 is disposed an optical fiber and/or fiber bundle 2, which preferably comprises at least an actual sensor fiber.

The rope 70 of rectangular cross-sectional shape presented in FIG. 1*g* comprises a plurality of load-bearing composite parts 71 that are rectangular in their cross-sectional shape and that are placed side-by-side in the width direction of the belt, which are surrounded by a polymer envelope 1. In the proximity of the surface of the composite parts 71, and/or between them, is an optical fiber and/or fiber bundle 2 laminated into the polymer envelope, which preferably comprise at least a sensor fiber and preferably also a reference fiber.

The rope 80 presented in FIG. 1*h* comprises two load-bearing composite parts 81 side-by-side that are rectangular in their cross-sectional shape and which are surrounded by a polymer envelope 1. The polymer envelope 1 comprises in the wide side of the rope 80 at a point of the area between the parts 81 a groove 82 for making the rope flexible, in which case the rope shapes itself well against, inter alia, curved surfaces. The rope can alternatively be guided by the aid of the grooves. In this way there can be more than two composite parts 101 side-by-side in this manner in the rope 100, in the manner presented in FIG. 1*j*. In the composite parts 81, 101 and in the proximity of the surface of the composite parts 81, 101 or between the composite parts is an optical fiber and/or fiber bundle 2 embedded into the polymer envelope 1, which preferably comprise at least a sensor fiber and a reference fiber. The reference fiber can also travel e.g. inside groove such that strain caused by the structure to be measured is not exerted on it. The polymer envelope can also be without a groove, the groove can be situated asymmetrically in relation to the symmetry axis of the rope, or it can be disposed in a different point than what is presented in the figure.

The rope 90 presented in FIG. 1*i* comprises a load-bearing composite part 91 that is rectangular in its cross-sectional shape, on both sides of which is a wire 92, both of which composite part 91 and which wire 92 are surrounded by a polymer envelope 1. The wire 92 can be a rope or a strand or a braiding and it is preferably from a shear-resistant material such as metal or aramid fiber. The wire can also comprise in connection with the rope or strand or braiding an optical fiber or fiber bundle 2, which preferably comprises at least a sensor fiber and a reference fiber. Instead of a wire, just an optical fiber and/or fiber bundle 2 can be at the side of the rope. Preferably the wire is at the same distance from the surface of the rope as the composite part 91. The metal protection can also be of another type, e.g. a metal batten or metal mesh following the composite part.

Figure 2:
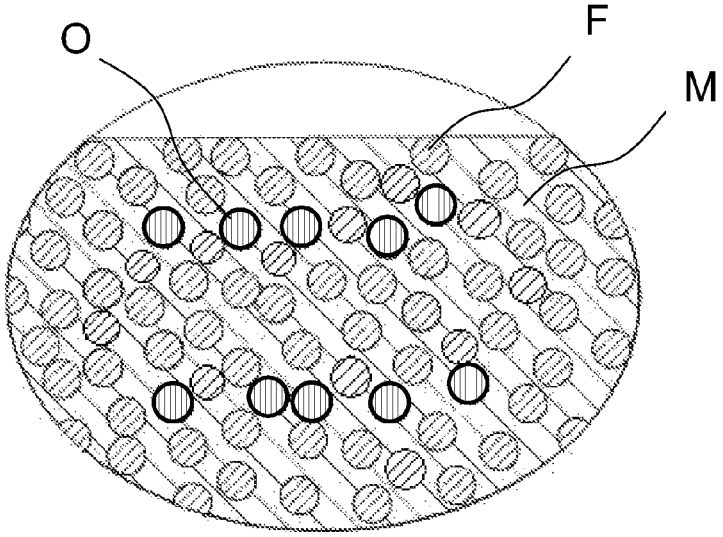
FIG. 2 presents schematically a magnified detail of a cross-section of a rope according to the invention.

FIG. 2 presents a preferred structure for a load-bearing composite part 11, 21, 31, 41, 51, 61, 71, 81, 91, 101. A partial cross-section of the surface structure of the load-bearing composite part (as viewed in the longitudinal direction of the rope) is presented inside the circle in the figure, according to which cross-section the reinforcing fibers of the load-bearing parts presented elsewhere in this application are preferably in a polymer matrix. The figure presents how the reinforcing fibers F are essentially evenly distributed in the polymer matrix M, which surrounds the fibers and is fixed to the fibers. An optical fiber and/or fiber bundle O, which function as actual sensor fibers, are disposed in the plurality of reinforcing fibers F. The reinforcing fibers can also be composed of unidirectional reinforcement layers laminated on above the other, preferably of prepeg layers. The polymer matrix M fills the areas between the reinforcing fibers F and the optical fibers O and binds essentially all the fibers F, O that are inside the matrix to each other as an unbroken solid substance. In this case relative abrasive movement between the fibers F, O and abrasive movement between the fibers F, O and the matrix M is essentially prevented. A chemical bond exists between, preferably all, the fibers F, O and the matrix M, one advantage of which is the homogeneity of the structure. To strengthen the chemical bond, there can be, but not necessarily is, a sizing (not presented) between the fibers F, O and the polymer matrix M. The polymer matrix M is of the kind described elsewhere in this application and can thus comprise additives for adjusting the properties of the matrix as a supplement to the base polymer. The polymer matrix M is preferably a hard thermosetting plastic, e.g. epoxy resin or polyester resin. The fact that the fibers F, O are in the polymer matrix in the load-bearing part means that in the invention the individual fibers F, O are bound to each other with a polymer matrix M, e.g. in the manufacturing phase by embedding them into the material of the polymer matrix. An optical fiber and/or fiber bundle can also be disposed in the manufacturing phase between the prepeg unidirectional layers or glued to the surface in the direction of the layers. In this case the intervals of individual fibers F, O bound to each other with the polymer matrix comprise the polymer of the matrix. Thus in the invention preferably a large amount of reinforcing fibers F and optical fibers O bound to each other in the longitudinal direction of the rope are distributed in the polymer matrix.

The reinforcing fibers are preferably distributed essentially evenly, i.e. homogeneously, in the polymer matrix such that the load-bearing part is as homogeneous as possible when viewed in the direction of the cross-section of the rope. In other words, the fiber content in the cross-section of the composite part does not therefore vary greatly. The reinforcing fibers and optical fibers together with the matrix form an unbroken load-bearing part, inside which relative abrasive movement does not occur when the rope bends. The individual fibers of the load-bearing part are mainly surrounded with the polymer matrix, but contacts between fibers can occur in places because controlling the position of the fibers in relation to each other in the simultaneous impregnation with the polymer matrix is difficult, and on the other hand totally perfect elimination of random contacts between fibers is not wholly necessary from the viewpoint of the functioning of the invention. If, however, it is desired to reduce their random occurrence, the individual fibers can be pre-coated such that a polymer sizing is around them already before the binding of individual fibers to each other. In the invention the individual fibers of the load-bearing part can comprise material of the polymer matrix around them such that the polymer matrix is immediately against the fiber, but alternatively a thin sizing of the fiber, e.g. a primer arranged on the surface of the fiber in the manufacturing phase to improve chemical adhesion to the matrix material, can be in between. An optical fiber can be protected with polyimide.

Individual reinforcing fibers are distributed evenly in the load-bearing part such that the intervals of individual reinforcing fibers comprise the polymer of the matrix. Preferably the majority of the intervals of the individual reinforcing fibers in the load-bearing part are filled with the polymer of the matrix. Most preferably essentially all of the intervals of the individual reinforcing fibers in the load-bearing part are filled with the polymer of the matrix. The matrix of the load-bearing part is most preferably hard in its material properties. A hard matrix helps to support the reinforcing fibers, especially when the rope bends. When bending, tension is exerted on the fibers of the outer surface of the rope and compression on the fibers of the inner surface in their longitudinal direction. Under the influence of compression the fibers try to buckle. When a hard material is selected as the polymer matrix, the crumpling of fibers can be prevented because the hard material is able to support the fibers and thus to prevent their crumpling and to equalize the stresses inside the rope. To reduce the bending radius of the rope, among other things, it is thus advantageous that the matrix material is a polymer that is hard, preferably something other than an elastomer (e.g. rubber) or something else that behaves elastically or gives way. The most preferred materials are epoxy, polyester, phenolic plastic and vinyl ester.

In the method according to the invention for monitoring the condition of a rope and/or roping, which rope 10, 20, 30, 40, 50, 60, 70, 80, 90, 100 and/or roping R comprises a plurality of load-bearing parts, inside which and/or in the proximity of the surface of which, and/or in the polymer matrix surrounding which one or more optical fibers and/or fiber bundles are integrated as sensor fibers and/or as reference fibers, and in the method the condition of the sensor fibers is monitored, e.g. by measuring the time-of-flight of a light pulse in a sensor fiber. The rope and/or roping is according to what is presented elsewhere in this patent application, e.g. in FIGS. 1*a*-1*j*. In the method the condition of all or part of a rope and/or roping is monitored by monitoring the condition of the sensor fibers, and if it is detected that a part of a sensor fiber has broken or the condition of it has fallen to below a certain predefined level, a need to replace or overhaul the rope or ropes is diagnosed and rope replacement work or rope maintenance work is started. In the method the time-of-flight of a light pulse can also be measured in different ropes, the times-of-flight of the light pulses can be compared with each other, and when the difference between the times-of-flight of the light pulses increases to above a predefined level, a need to replace or overhaul the rope or ropes is diagnosed and rope replacement work or rope maintenance work is started.

Figure 3:
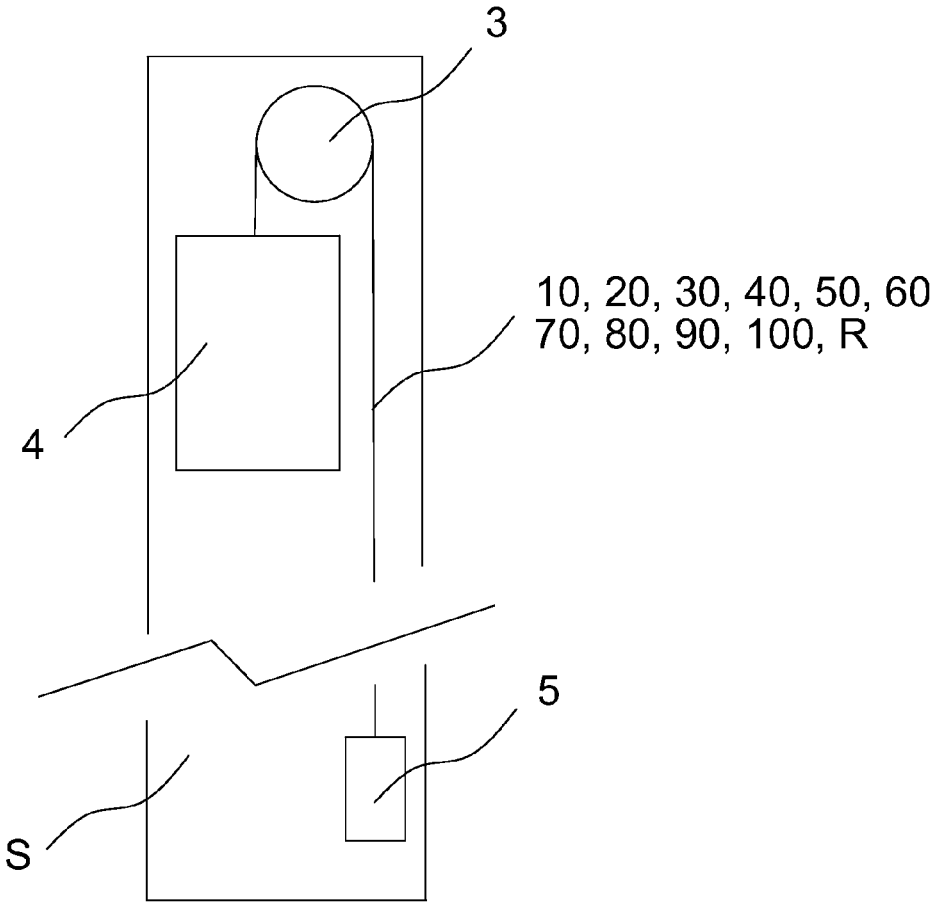
FIG. 3 presents one embodiment of an elevator according to the invention.

FIG. 3 presents one embodiment of an elevator according to the invention, in which the hoisting roping of the elevator is according to what is presented elsewhere in this patent application, e.g. according to what is defined in the description of any of FIGS. 1*a*-1*j*. The roping 10, 20, 30, 40, 50, 60, 70, 80, 90 100, R is fixed at its first end to the elevator car 4 and at its second end to the counterweight 5. The roping is moved with a traction sheave 3 supported on the building, to which traction sheave a power source, such as e.g. an electric motor (not shown), that rotates the traction sheave is connected. The rope is preferably any of the type presented in FIGS. 1*a*-1*j* in its structure. The elevator is preferably a passenger transport elevator and/or freight transport elevator, which is installed to travel in an elevator hoistway S in a building.

Figure 4:
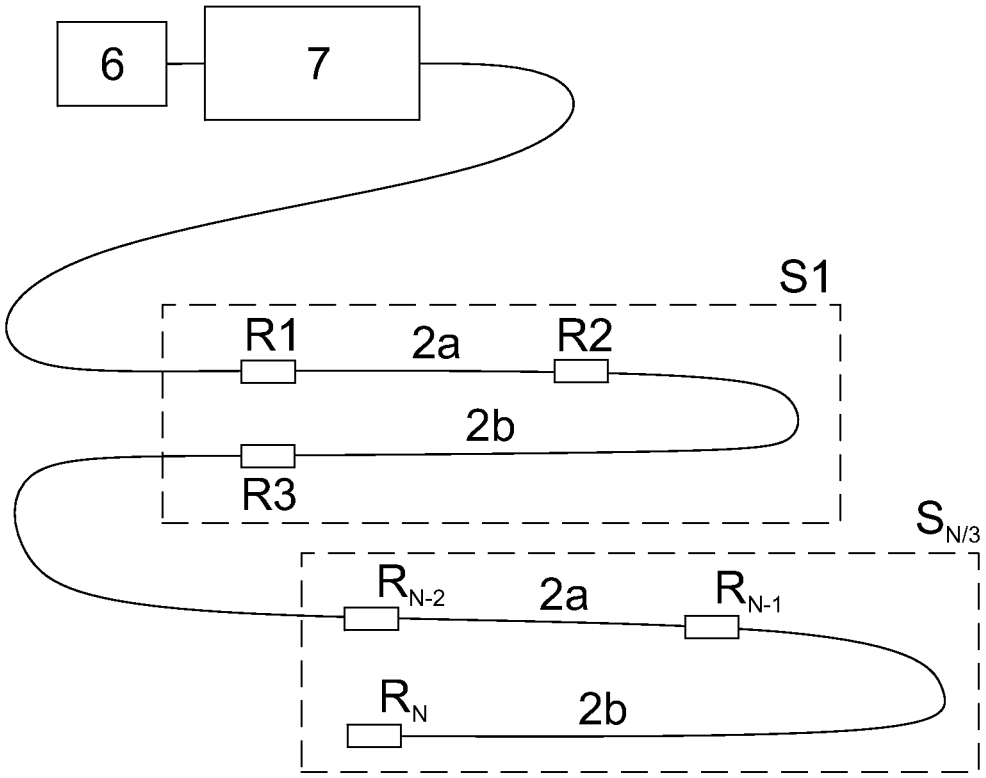
FIG. 4 presents schematically a measuring system according to one embodiment of the condition monitoring method for a rope according to the invention.

FIG. 4 presents one embodiment of a condition monitoring method for a rope or roping of an elevator according to the invention, wherein the elevator preferably comprises a separate condition monitoring arrangement functioning on the Time-Of-Flight TOF principle, which condition monitoring arrangement comprises a condition monitoring device 7 connected to the sensor fibers 2*a* and to the reference fibers 2*b* of the rope, which device comprises means, such as a computer comprising a laser transmitter, receiver, timing discriminator, a circuit measuring a time interval, a programmable logic circuit and a processor 6. The condition monitoring arrangement comprises one or more sensors S1, $S_{N/3}$, each of which sensors comprises e.g. reflectors R1, R2, R3, $R_{N-2}$, $R_{N-1}$, $R_N$, where N is the number of reflectors, and a processor 6, which when they detect a change, e.g. in the time-of-flight of the light pulse in the sensor fiber 2*a*, raise an alarm about excessive wear of the rope. With the reference fibers 2*b* common mode errors, caused e.g. by changes in temperature, can be eliminated. A number of sensor fibers 2*a* and the reference fibers 2*b* can be connected to each other in series and reflectors R1, R2, R3, $R_{N-2}$, $R_{N-1}$, $R_N$ are situated in the fiber connectors. On the basis of the time-of-flight of a light pulse, preferably by comparing with the aid of the processor to predetermined limit values, the condition monitoring device is arranged to deduce the condition of the load-bearing part in the area between the reflectors. The condition monitoring device can be arranged to initiate an alarm if the time-of-flight of the light pulse does not fall within the desired value range or differs sufficiently from the measured values of the time-of-flight of the light pulse for other ropes being measured. The time-of-flight of the light pulse changes when a property that depends on the condition of a load-bearing part of the rope, such as strain or displacement, changes. For example, owing to breaks the time-of-flight of the light pulse changes, from which change it can be deduced that the load-bearing part is in poor condition.

The property to be observed can also be e.g. a change in the amount of light traveling through the rope. In this case light is fed into an optical fiber with a laser transmitter or with a LED transmitter from one end and the passage of the light through the rope is assessed visually or by the aid of a photodiode at the other end of the fiber. The condition of the rope is assessed as having deteriorated when the amount of light traveling through the rope clearly decreases.

In one embodiment of the condition monitoring method for a rope an optical fiber functions as an optical Fabry-Pérot-type sensor. A Fabry-Pérot interferometer FPI comprises two reflective surfaces, or two parallel highly reflective dichroic mirrors, at the end of the fiber. When it hits the mirrors a part of the light passes through and a part is reflected back. After the mirror the light passing through travels e.g. through air, after which it is reflected back from the second mirror. Some of the light has traveled a longer distance in a different material, which has caused changes in the properties of the light. Strain causes changes in e.g. the phase of the light. The light with changed properties interferes with the original light, after which the change is analyzed. After the lights have combined they end up in a receiver and in a signal-processing device. With the method the strain of the fiber, and thus the condition of the rope, is assessed.

In one embodiment of the condition monitoring method for a rope an optical fiber is used, which fiber comprises Bragg gratings, i.e. the so-called Fiber Bragg Grating FBG method is applied in the condition monitoring of the rope. Periodic grating structures are made in a single-mode fiber for the FBG sensor, which grating structures reflect a certain wavelength of the light corresponding to the grating back. When light is conducted into the fiber, the wavelength of the light corresponding to the grating is reflected back. When strain is exerted on the grating structure, the refractive index of the fiber changes. Changing of the refractive index affects the wavelength of the light being reflected back. By monitoring changes in wavelength, a change in the strain exerted on the grating can be ascertained, and thus also the condition of the rope. There can be tens or hundreds of gratings by the side of the same fiber.

In one embodiment of the condition monitoring method for a rope a distributed sensor fiber based on Brillouin spectrum measurement is used. Ordinary single-mode fiber or multimode fiber can be used as a sensor. The optical fiber functions as a distributed sensor, which can function as a sensor that is hundreds of meters long, which measures throughout its length and corresponds if necessary to thousands of point-form sensors. Backscattering of light occurs continuously as the light propagates in the fiber. This can be utilized by monitoring the strength of certain backscattering wavelengths. Brillouin scattering arises in the manufacturing phase in non-homogeneous points created in the fiber. By observing the wavelengths of the original and the scattered light signal the strain of the fiber, and thus the condition of the rope, is determined.

The effect of temperature on strain measurements can be eliminated by, inter alia, using a reference fiber as an aid, which reference fiber is installed such that strain caused by the structure to be measured is not exerted on it.

It is obvious to the person skilled in the art that in developing the technology the basic concept of the invention can be implemented in many different ways. The invention and the embodiments of it are not therefore limited to the examples described above, but instead they may be varied within the scope of the claims.

The invention claimed is:

1. A rope of a lifting device for an elevator, wherein:

a width of the rope is greater than a thickness of the rope in a transverse direction of the rope, the rope comprises:

a load-bearing part in a longitudinal direction of the rope, the load-bearing part comprises a composite material in a polymer matrix, a cross-section of the load-bearing part in the transverse direction of the rope has two parallel edges extending in the transverse direction of the rope, said parallel edges having a length greater than a thickness of the load-bearing part that is perpendicular to the parallel edges, one or more optical fibers and/or fiber bundles in connection with the load-bearing part, and at least one of the one or more optical fibers and/or fiber bundles is located outside of the load-bearing part, wherein the composite material comprises carbon-fibers, aramid fibers and/or glass-fibers in the polymer matrix, wherein the load-bearing part is completely surrounded by an envelope comprising a polymer and is continuous in the longitudinal direction of the rope, and wherein the at least one of the one or more optical fibers and/or fiber bundles located outside of the load-bearing part is embedded in the envelope.

2. The rope according to claim 1, wherein the structure of the rope continues essentially the same for the whole length of the rope, and the load-bearing part comprises prepeg reinforcement layers laminated together and at least one other optical fiber and/or fiber bundle of the one or more optical fibers and/or fiber bundles is laminated between and/or on the surface of the reinforcement layers.

3. The rope according to claim 1, wherein fibers of the load-bearing part are arranged in a longitudinal direction and are laminated into the polymer matrix, and at least one other optical fiber and/or fiber bundle of the one or more optical fibers and/or fiber bundles is arranged to be mixed into the reinforcement.

4. The rope according to claim 1, wherein the load-bearing part comprises at least one other optical fiber and/or fiber bundle of the one or more optical fibers and/or fiber bundles, which extends essentially a length of the load-bearing part, and the at least one other of the optical fiber and/or fiber bundle extends continuously in the direction of the load-bearing part essentially from a first end of the load-bearing part to a second end of the load-bearing part at least once.

5. The rope according to claim 1, wherein an input and a reception of a light pulse of the one or more optical fibers and/or fiber bundles is at a same end of the rope or the input and the reception of the light pulse of the one or more optical fibers and/or fiber bundles are at opposite ends of the rope.

6. The rope according to claim 1, wherein a single-mode or multimode fiber is used as a sensor fiber of the one or more optical fibers or fiber bundles and an input of the light pulse occurs with a laser transmitter or with a LED light source.

7. The rope according to claim 1, wherein the one or more optical fibers and/or fiber bundles comprises a Fabry-Perot-type sensor fiber.

8. The rope according to claim 1, wherein the one or more optical fibers and/or fiber bundles comprises a sensor fiber, comprising a Bragg grating structure.

9. The rope according to claim 1, wherein the one or more optical fibers and/or fiber bundles comprises a sensor fiber, which functions as a Brilloun distributed fiber sensor.

10. The rope according to claim 1, wherein the one or more optical fibers and/or fiber bundles comprises a sensor fiber, in which fiber the time-of-flight of a light pulse is measured.

11. A rope arrangement of a lifting device of an elevator, which rope arrangement comprises a plurality of ropes, which are arranged to move the elevator car, wherein at least one of the ropes is the rope according to claim 1.

12. The rope according to claim 1, wherein the at least one of the one or more optical fibers and/or fiber bundles is glued onto the surface of the load-bearing part and is embedded into the polymer envelope surrounding the load-bearing part and at least another of the one or more optical fibers and/or fiber bundles are located inside the load-bearing part.

13. An elevator comprising:

an elevator car, a traction sheave, a power source for rotating the traction sheave, and the rope according to claim 1, wherein the elevator car is arranged to be moved by aid of the rope.

14. The elevator according to claim 13, wherein the rope is arranged to move the elevator car and a counterweight.

15. The elevator according to claim 13, wherein the rope is an overspeed governor rope and/or a compensating rope.

16. The elevator according to claim 13, wherein the elevator comprises a device configured to monitor a condition of the optical fiber and/or a fiber bundle, which comprises a number of optical fibers, the device configured to monitor a condition of the optical fiber by monitoring a strain and/or displacement and/or condition of the optical fiber and/or fiber bundle of the load-bearing part of the rope.

17. A condition monitoring method for a rope of a lifting device for an elevator, the condition monitoring method comprising the steps of:

monitoring a condition of the rope by monitoring a condition of an optical fiber and/or fiber bundle, the rope including:

a load-bearing part, wherein the optical fiber and/or fiber bundle being located outside of the load-bearing part, a cross-section of the load-bearing part in the transverse direction of the rope having two parallel edges extending in the transverse direction of the rope, said parallel edges having a length greater than a thickness of the load-bearing part that is perpendicular to the parallel edges; and when a detected strain and/or displacement of the optical fiber and/or fiber bundle has increases, and/or the condition of the optical fiber and/or fiber bundle has decreases, beyond a pre-defined limit value, diagnosing a need to replace or overhaul the rope and starting rope replacement work or rope maintenance work, wherein the rope comprises the load-bearing part in a longitudinal direction of the rope, the load-bearing part comprises a composite material in a polymer matrix, wherein the rope comprises one or more additional optical fibers and/or fiber bundles in connection with the load-bearing part, wherein the composite material comprises carbon-fibers, aramid fibers and/or glass-fibers in the polymer matrix, wherein the load-bearing part is completely surrounded by an envelope comprising a polymer and is continuous in the longitudinal direction of the rope, and wherein the optical fiber and/or fiber bundle located outside of the load-bearing part is embedded in the envelope.

18. The method according to claim 17, wherein a width of the rope is greater than a thickness in the transverse direction of the rope.

19. The method according to claim 18, wherein at least one of the one or more additional optical fibers and/or fiber bundles is embedded in the load-bearing part and wherein at least another one of the one or more additional optical fibers and/or fiber bundles is glued onto the surface of the load-bearing part.

20. The method according to claim 17, wherein a single-mode or multimode fiber is used as the sensor fiber of the optical fiber or fiber bundle and the input of the light pulse occurs with a laser transmitter.

21. The method according to claim 17, wherein the optical fiber and/or fiber bundle comprises a sensor fiber and a reference fiber, with which common mode errors, caused by changes in temperature, are eliminated.

22. The method according to claim 17, wherein the optical fiber and/or fiber bundle comprises a Fabry-Perot-type sensor fiber, with which the strain and/or displacement of the rope is measured.

23. The method according to claim 17, wherein the optical fiber and/or fiber bundle comprises a sensor fiber, comprising a Bragg grating structure, with which the strain and/or displacement of the rope is measured.

24. The method according to claim 17, wherein the optical fiber and/or fiber bundle comprises a sensor fiber, which functions as a Brilloun distributed fiber sensor, with which the strain and/or displacement of the rope is measured.

25. The method according to claim 17, wherein the optical fiber and/or fiber bundle comprises a sensor fiber, the time-of-flight of a light pulse in which fiber is measured, and with which the strain and/or displacement of the rope is measured.

26. The method according to claim 17, wherein the time-of-flight of a light pulse and/or strain are measured in a number of ropes, and when the measured values of which ropes differ a predetermined amount from each other, a need to replace or overhaul the rope or ropes is diagnosed and rope replacement work or rope maintenance work is started.

27. The method according to claim 17, wherein at least one of the one or more additional optical fibers and/or fiber bundles is disposed in the polymer envelope.

* * * * *